US009301346B2

(12) United States Patent
Moriya et al.

(10) Patent No.: US 9,301,346 B2
(45) Date of Patent: Mar. 29, 2016

(54) POWER SUPPLY FOR A HIGH FREQUENCY HEATING

(75) Inventors: Hideaki Moriya, Nara (JP); Haruo Suenaga, Osaka (JP); Shinichi Sakai, Nara (JP); Nobuo Shirokawa, Nara (JP); Manabu Kinoshita, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1494 days.

(21) Appl. No.: 12/064,911

(22) PCT Filed: Aug. 25, 2006

(86) PCT No.: PCT/JP2006/316769

§ 371 (c)(1),
(2), (4) Date: Feb. 26, 2008

(87) PCT Pub. No.: WO2007/023962

PCT Pub. Date: Mar. 1, 2007

(65) Prior Publication Data

US 2009/0134153 A1 May 28, 2009

(30) Foreign Application Priority Data

Aug. 26, 2005 (JP) ..... 2005-245619

(51) Int. Cl.
*H05B 6/66* (2006.01)
*H05B 6/68* (2006.01)

(52) U.S. Cl.
CPC ..... *H05B 6/681* (2013.01); *H05B 6/666* (2013.01)

(58) Field of Classification Search
CPC ..... H05B 6/681; H05B 6/685; H05B 6/66; H05B 6/666; H05B 6/68; H05B 6/668
USPC ..... 219/715, 716, 718, 721, 702, 760, 722, 219/678, 679, 680, 681, 682, 761; 363/16, 363/17, 21.02, 21.04, 49, 74, 98; 323/235, 323/236, 319
See application file for complete search history.

(56) References Cited

U.S. PATENT DOCUMENTS 4,967,051 A * 10/1990 Maehara et al. ..... 219/721
5,274,208 A 12/1993 Noda (Continued)

FOREIGN PATENT DOCUMENTS

EP 1 742 512 A1 1/2007
JP 4-32191 2/1992

(Continued)

OTHER PUBLICATIONS

International Search Report for PCT/JP2006/316769; Nov. 13, 2006.

(Continued)

*Primary Examiner* — Hung D Nguyen
(74) *Attorney, Agent, or Firm* — Pearne & Gordon LLP

(57) ABSTRACT

A power supply for a high frequency heating is provided. When processes from a non-oscillation to an oscillation of a magnetron are finely classified, the non-oscillation (a start mode), the oscillation (a start mode), and the oscillation (a steady mode) are obtained. A problem resides in an unstable state immediately after the oscillation. When a PWM setting value at this time is set to a value lower than a PWM setting value in the steady mode, even if the PWM setting value during the steady mode is set to a maximum output value, the input current is not controlled to a large current including the over-shoot immediately after the oscillation. After the magnetron shifts to a stable state, the PWM setting value shifts to a PWM setting value of an actual steady mode, so that the over-shoot of the input current can be suppressed as much as possible.

5 Claims, 11 Drawing Sheets

(56) References Cited

U.S. PATENT DOCUMENTS

| | | | | |
|---|---|---|---|---|
| 2004/0074900 | A1* | 4/2004 | Suenaga et al. | 219/600 |
| 2005/0121442 | A1* | 6/2005 | Shin | 219/715 |

FOREIGN PATENT DOCUMENTS

| | | | | | |
|---|---|---|---|---|---|
| JP | 07-161464 | A | | 6/1995 | |
| JP | 07161464 | A | * | 6/1995 | H05B 6/68 |
| JP | 8-227790 | | | 9/1996 | |
| JP | 11-87048 | | | 3/1999 | |
| JP | 2000-21559 | | | 1/2000 | |
| JP | 2001-210463 | | | 8/2001 | |
| JP | 2001210463 | A | * | 8/2001 | H05B 6/68 |
| JP | 2003-308960 | | | 10/2003 | |
| JP | 2003308960 | A | * | 10/2003 | H05B 6/68 |
| JP | 2005-317306 | | | 11/2005 | |
| JP | 2005-317306 | A | | 11/2005 | |
| WO | 2005-107326 | | | 11/2005 | |

OTHER PUBLICATIONS

European Search Report dated Jun. 23, 2009.

* cited by examiner

POWER SUPPLY FOR A HIGH FREQUENCY HEATING

TECHNICAL FIELD

The present invention relates to a control for suppressing an overshoot of an input current generated from an unstable state immediately after the oscillation of a magnetron in the field of a high frequency heating device for carrying out an inductive heating operation by driving the magnetron such a microwave oven.

BACKGROUND ART

As a power source used in a high frequency heating cooking device such as a microwave oven employed in an ordinary home, a compact and light power source has been desired in view of its quality (to make it portable and a cooking chamber large, the space of a mechanical chamber in which the power source is incorporated is desired to be small). Therefore, the power source has been progressively compact, light and inexpensive by introducing a switching power supply and an inverter power source has been mainly used. Further, a high output is required so that a technology for controlling a large current is necessary. Especially, it is a problem how to suppress the overshoot of an input current generated when the magnetron radiating a microwave begins oscillating from a non-oscillating state and a control system thereof is proposed (for instance, see Patent Document 1).

FIG. 9 shows one example of a power supply for a high frequency heatingpower supply for a high frequency heating (an inverter power source) for driving a magnetron. The power supply for a high frequency heatingpower supply for a high frequency heating includes a dc power source 1, a leakage transformer 2, a first semiconductor switching element 3, a first capacitor 5 (a snubber capacitor), a second capacitor 6 (a resonance capacitor), a third capacitor 7 (a smoothing capacitor), a second semiconductor switching element 4, a driving part 13, a Delon-Greinacher circuit 11 and a magnetron 12.

The dc power source 1 rectifies a commercial power to apply a dc voltage VDC to a series circuit of the second capacitor 6 and a primary winding 8 of the leakage transformer 2. The first semiconductor switching element 3 is connected in series to the second semiconductor switching element 4 and the series circuit of the second capacitor 6 and the primary winding 8 of the leakage transformer 2 is connected in parallel with the second semiconductor switching element 4.

The first capacitor 5 is connected in parallel with the second semiconductor switching element 4 and plays a role of a snubber for suppressing a rush current (voltage) generated during switching. An ac high voltage output generated in a secondary winding 9 of the leakage transformer 2 is converted to a dc high voltage in the Delon-Greinacher circuit 11 and applied to a part between an anode and a cathode of the magnetron 12. A tertiary winding 10 of the leakage transformer 2 supplies a current to the cathode of the magnetron 12.

The first semiconductor switching element 3 and the second semiconductor switching element 4 are composed of IGBTs and free-wheeling diodes connected in parallel therewith. It is to be understood that the first and second semiconductor switching elements 3 and 4 are not limited to this kind and a thyristor, a GTO switching element or the like may be used.

The driving part 13 has therein an oscillating part for forming a driving signal of the first semiconductor switching element 3 and the second semiconductor switching element 4. In this oscillating part, a rectangular wave of a predetermined frequency is generated and a DRIVE signal is supplied pt the first semiconductor switching element 3 and the second semiconductor switching element 4. Immediately after one of the first semiconductor switching element 3 or the second semiconductor switching element 4 is turned off, since the voltage at both ends of the other semiconductor switching element is high, when the semiconductor switching element is turned off at this time, a spike shaped over-current is supplied to generate an unnecessary loss and noise. However, since a dead time is provided so that a turning off operation is delayed until the voltage at both ends is decreased to about 0V, the generation of the unnecessary loss and noise can be prevented. It is to be understood that the same function is realized during an opposite switching operation.

A detailed operation of each mode by the DRIVE signal supplied by the driving part 13 is omitted. As a feature of the circuit structure of FIG. 9, even in 240 V of Europe as the highest voltage in a power source for an ordinary home, a voltage generated in the first semiconductor switching element 3 and the second semiconductor switching element 4 is the same as the dc source voltage VDC, that is, $240\sqrt{2}=339$V. Accordingly, even when an abnormality such as a lightning surge or an instantaneous voltage drop is assumed to arise, for the first semiconductor switching element 3 and the second semiconductor switching element 4, an inexpensive voltage resistant product of about 600 V can be used without a problem. Further, an input current Iin and a reference voltage (REF) depending on each output level are controlled by an input current constant control part 14, so that the driving part 13 obtains a desired output level.

FIG. 10 shows a state that the magnetron does not oscillate to a state that the magnetron oscillates by the operation of the inverter power source in the input current Iin. Time is shown in an axis of abscissa and the input current Iin(A) and a control signal for the input current (a PWM signal from a microcomputer) are shown in an axis of ordinate on duty. When processes from a non-oscillation to an oscillation of the magnetron are finely classified, 1) a non-oscillation (a start mode), 2) an oscillation (a start mode) and 3) an oscillation (a steady mode) are obtained. Initially, in 1) the non-oscillation (the start mode), under a state of an impedance of infinity that the magnetron does not oscillate, only the input current Iin slightly flows. Accordingly, it is to be understood that a desired input shown by the PWM is not obtained. 2) the oscillation (the start mode) is a part that needs to be improved this time. That is, this part is an area where it is hard that the input current is accurately controlled under the unstable state of the magnetron immediately after the oscillation, and as shown in FIG. 9, an over-shoot is found. In 3) the oscillation (the steady) mode, this area may be said to be an area where a stable input current control can be realized.

Now, FIG. 11 shows resonance characteristics in an inverter power circuit of this kind (a resonance circuit is formed with an inductance L and a capacitance C). FIG. 11 is a diagram showing current-characteristics of working frequency when a constant voltage is applied and frequency f0 indicates a resonance frequency. In an actual operation of the inverter, current-frequency characteristics 11 (a full line part) located within a range of frequencies f1 to f3 higher than the frequency f0 are used.

Namely, at the time of the resonance frequency f0, the current I1 is maximum. As the range of the frequencies is higher toward f1 to f3, the current I1 is more decreased, because as the frequency is lower within the range of f1 to f3, the frequency comes nearer to the resonance frequency, the current supplied to the secondary side of the leakage transformer is increased. On the contrary, when the frequency is higher, the frequency is more remote from the resonance frequency, the current of the secondary side of the leakage transformer is more decreased. In an inverter power source for driving the magnetron as a non-linear load, a desired output is obtained by changing the frequency. For instance, continuous linear outputs that cannot be got in an LC power source can be obtained in such a way that an output is obtained in the vicinity of f3 when 200 W output is used, an output is obtained in the vicinity of f2 when 600 W output is used and an output is obtained in the vicinity of f1 when 1200 W is used. An operating frequency for each output level is supplied by the driving part 13 shown in FIG. 9, however, the contents thereof are realized by the input control constant circuit part 14 that controls the input current converted to voltage to be the same as the reference voltage of each output level. Further, since an ac commercial power source is used, to meet the characteristics of the magnetron that does not oscillate a high frequency when a high voltage is not applied in the vicinities of 0° and 180° of power phases, the operating frequency of the inverter is set, in this section, to a frequency near f1 in which a resonance current is increased. Thus, a boost ratio of magnetron applied voltage to a commercial source voltage can be enhanced and a conductive angle that emits a radio wave can be widened.

Patent Document 1: JP-A-2000-21559

DISCLOSURE OF THE INVENTION

Problems that the Invention is to Solve

However, the above-described structure has following problems.

That is, since a signal (REF) serving as a reference when the input current is controlled is set (a control signal for an input current from a microcomputer of an external control board is used), a current actually supplied to the inverter power source is converted into a voltage and controlled so as to be the same as the above-described reference signal REF, a problem arises that the over-shoot of the input current generated under an unstable state immediately after an oscillation from a non-oscillation of the magnetron is increased at the time of a maximum output.

Means for Solving the Problems

I order to solve the above-described problem, the present invention provides a structure that can suppress an over-shoot immediately after an oscillation by changing a PWM setting value of a control signal for an input current in a non-oscillation (a start mode) and an oscillation (a steady mode) of a magnetron.

In the above-described structure, the present invention can suppress the over-shoot of an input current under an unstable state immediately after the magnetron begins oscillating from a state that the magnetron does not oscillate, avoid an overload from being applied to parts respectively and realize a smooth oscillation of the magnetron (a shift from the start state to the steady state). Further, the present invention can also solve a problem such as a shut-down caused by detecting an over-voltage generated at the time of the over-shoot as an abnormal voltage.

Advantage of the Invention

According to the power supply for a high frequency heatingpower supply for a high frequency heating, even if the PWM setting value during the steady mode is set to a maximum output value, the input current does not need to be controlled to a large current including the over-shoot immediately after the oscillation. After the magnetron shifts to a stable state, the PWM setting value shifts to a PWM setting value of an actual steady mode, so that the over-shoot of the input current can be suppressed as much as possible.

DESCRIPTION OF REFERENCE NUMERALS AND SIGNS

Figure 1:
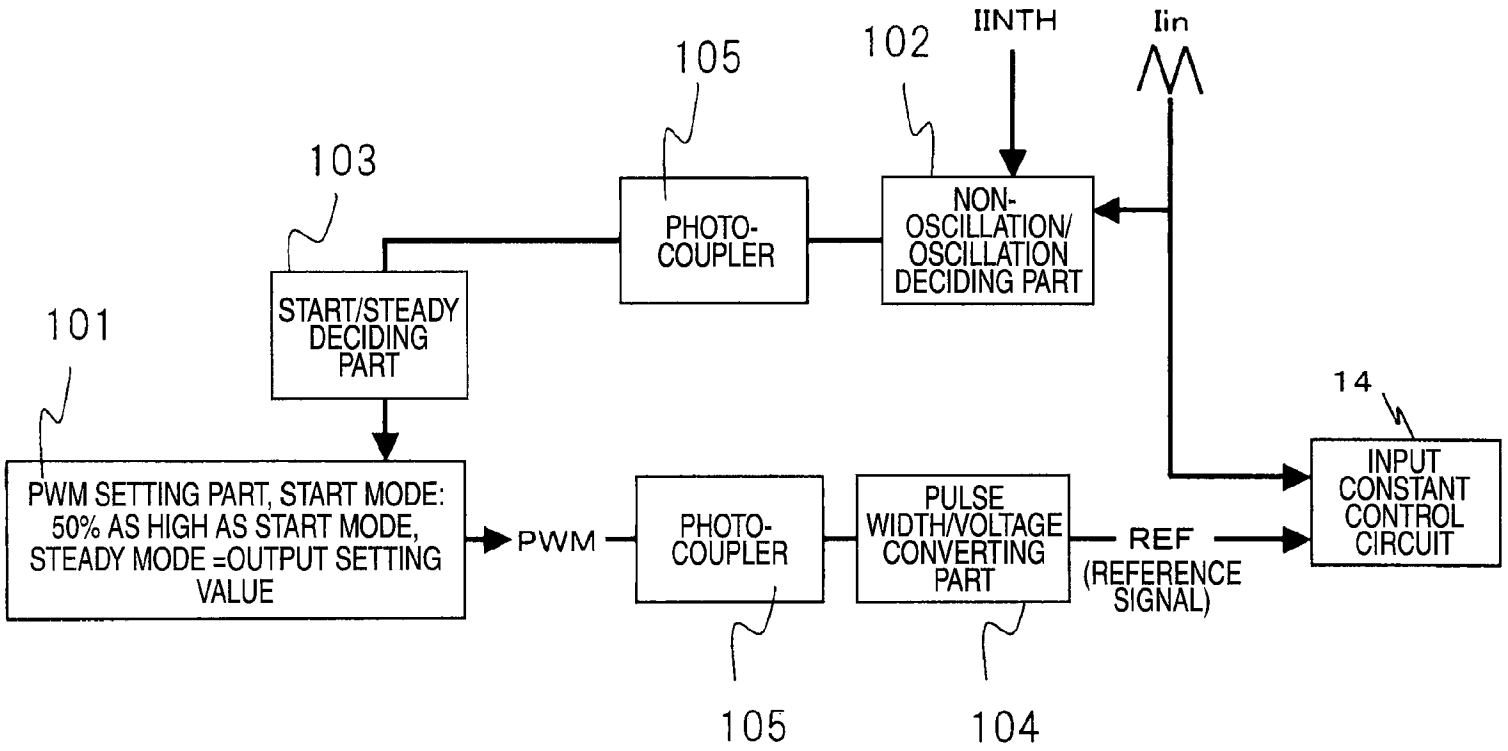
FIG. 1 is a schematic block diagram of an inverter power source for driving a magnetron of a first embodiment of the present invention.

1 . . . dc power source
2 . . . leakage transformer
3 . . . first semiconductor switching element
4 . . . second semiconductor switching element
5 . . . first capacitor
6 . . . second capacitor
7 . . . third capacitor
11 . . . Delon-Greinacher circuit
12 . . . magnetron
13 . . . driving part
14 . . . input constant control circuit
101, 201, 301, 401 . . . PWM setting part
102 . . . non-oscillation/oscillation deciding part
103 . . . start/steady deciding part
104 . . . pulse width/voltage converting part
105 . . . photo-coupler

BEST MODE FOR CARRYING OUT THE INVENTION

The first invention provides a power supply for a high frequency heating that drives a magnetron by carrying out a high frequency switching operation by a semiconductor switching element using a commercial power source, characterized in that a control signal for an input current is used to suppress an over-shoot of the input current immediately after the magnetron begins oscillating.

A second invention provides a power supply for a high frequency heating according to the invention, characterized in that the control signal for the input current sets different values in a non-oscillation (a start mode) and an oscillation (a steady mode) of the magnetron.

A third invention provides a power supply for a high frequency heating according to the invention, characterized in that the setting value of the start mode of the control signal for the input current is gradually changed to the setting value of the steady mode after the magnetron begins oscillating.

A fourth invention provides a power supply for a high frequency heating according to the invention, characterized in that the setting value of the start mode of the control signal for the input current is constant irrespective of each output level of the steady mode.

A fifth invention provides a power supply for a high frequency heating according to the invention defined in claim 3, characterized in that the setting value of the start mode of the control signal for the input current is set so as to be the same as an IINTH threshold value for determining whether the non-oscillation or the oscillation (both in the start mode) and then changed with the same inclination irrespective of each output level when the setting value of the start mode shifts to the setting value in the steady mode.

According to the above-described structure, the over-shoot of an input current can be suppressed that is generated under an unstable state immediately after the magnetron begins oscillating from a state that the magnetron does not oscillate, an overload can be avoided from being applied to parts respectively and a smooth oscillation (a shift from the start state to the steady state) of the magnetron can be realized. Further, the present invention can also solve a problem such as a shut-down caused by detecting an over-voltage generated at the time of over-shoot as an abnormal voltage.

Figure 9:
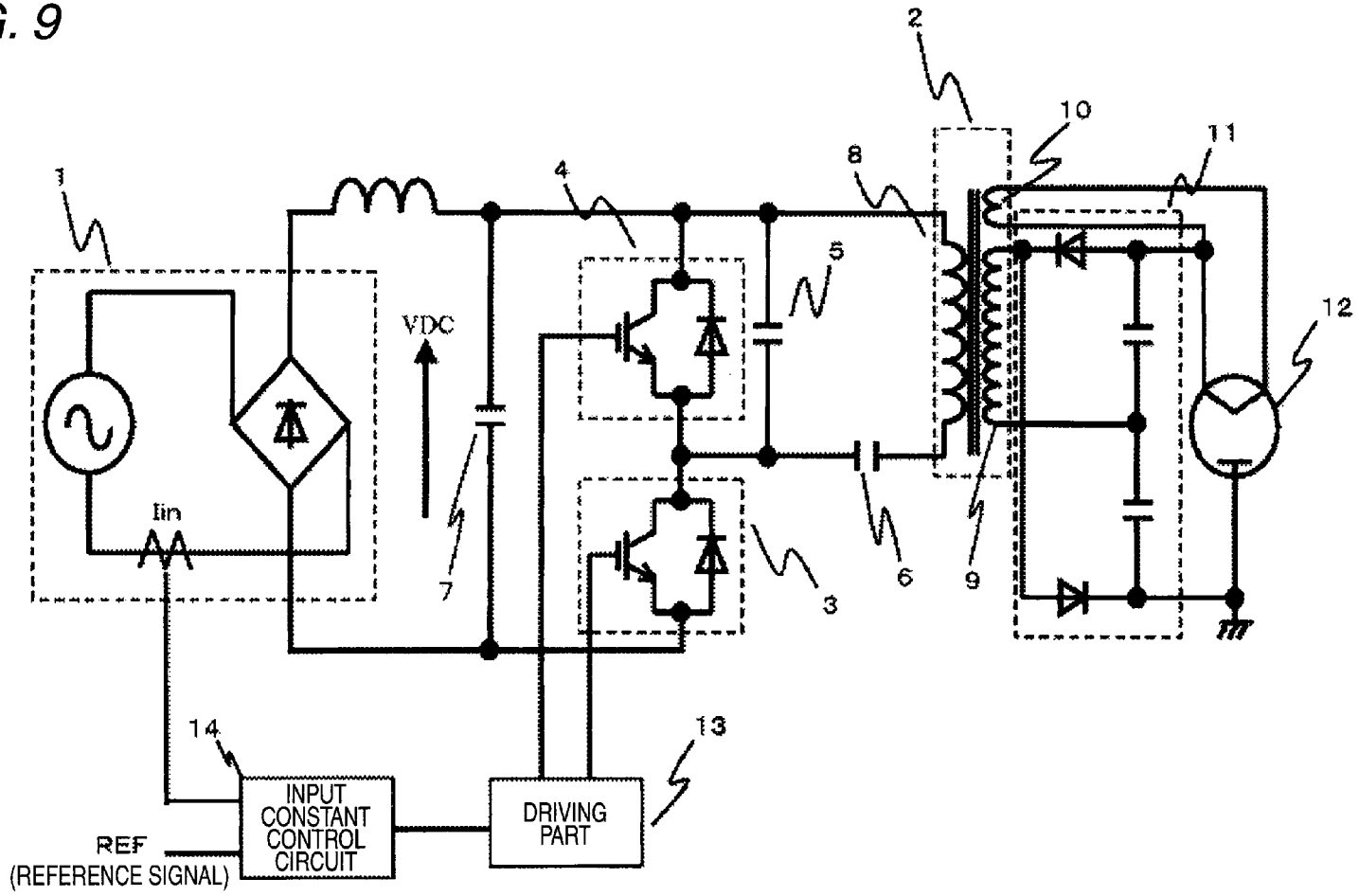
FIG. 9 is a circuit block diagram of a power supply for a high frequency heatingpower supply for a high frequency heating.
Figure 10:
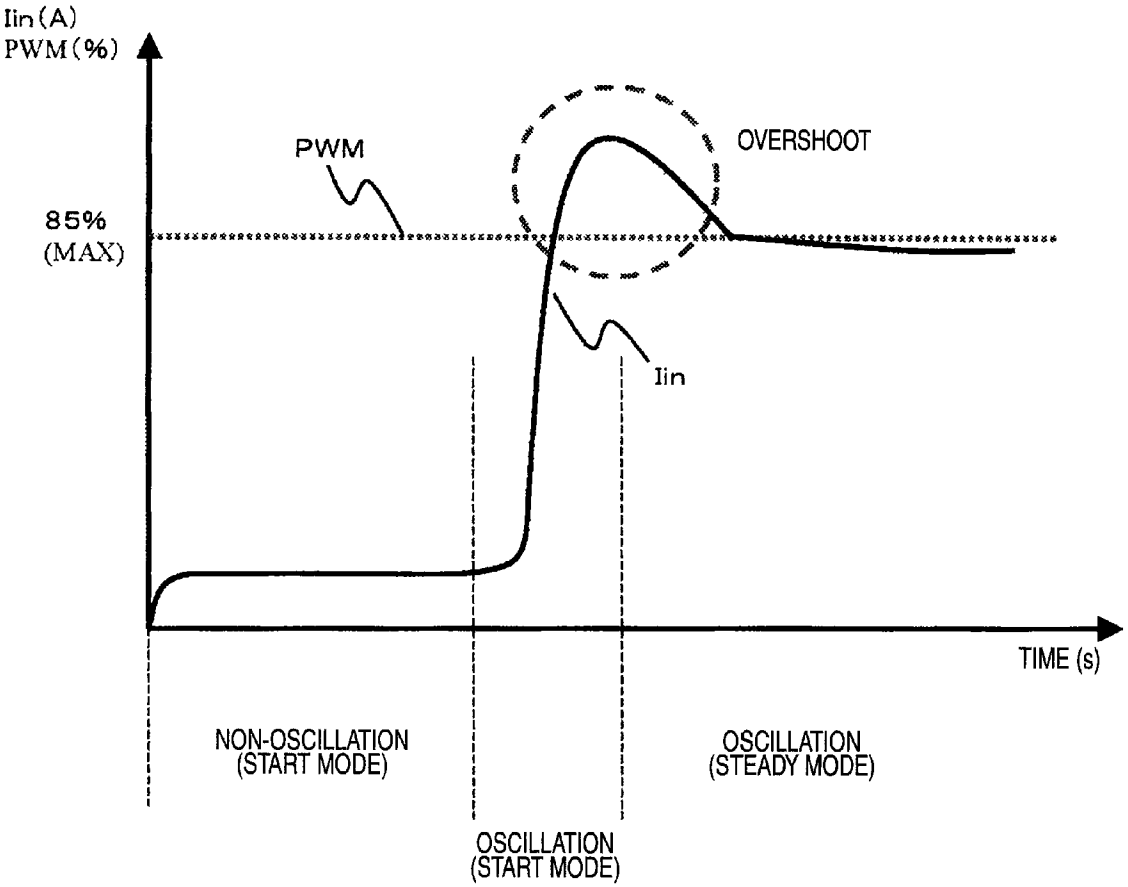
FIG. 10 is a figure of an input current characteristic in the transition from a non-oscillation to an oscillation of a usual magnetron.
Figure 11:
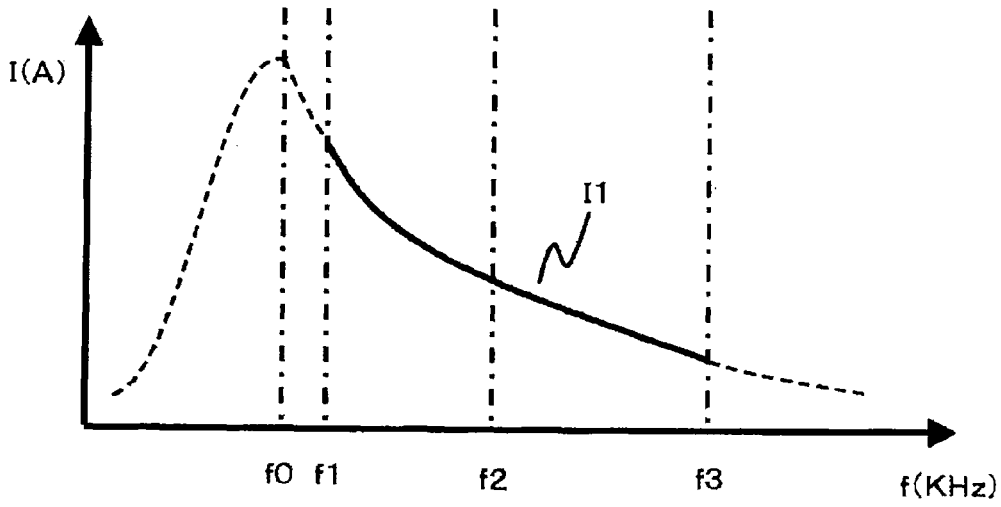
FIG. 11 shows a graph of a current-working frequency characteristic when a constant voltage is applied to an inverter resonance circuit.

Now, embodiments of the present invention will be described below by referring to the drawings. As described above, the present invention has a structure that can suppress the over-shoot immediately after the oscillation by changing the PWM setting values of the control signal for the input current in the non-oscillation (the start mode) and the oscillation (the steady mode) of the magnetron. Structures shown following a REF output signal in FIGS. 1, 3, 5, and 7 are the same as the structure of FIG. 9. The present invention is not limited by the embodiments.

First Embodiment

FIG. 1 shows a schematic block diagram of an inverter power source for driving a magnetron of a first embodiment of the present invention. As described above, since the structure following a REF signal is the same as the usual structure shown in FIG. 9, an explanation thereof is omitted herein.

A PWM setting part 101 shown in FIG. 1 sets different PWMs in the start mode and the steady mode. A non-oscillation/oscillation deciding part 102 compares an IINTH signal with an Iin signal to switch the start mode to the steady mode. That is, IINTH>Iin is decided to be a non-oscillation and IINTH<Iin is decided to be an oscillation. After a time lag is provided, the signal is inputted to the PWM setting part 101 via a start/steady deciding part 103 to determine whether an outputted PWM signal is set to a start mode value or a steady mode value.

In a pulse width/voltage converting part 104, the PWM signal is converted into a voltage in a form proportional to an on duty ratio of the PWM. For instance, when PWM=85%, the signal can be set to a reference signal of REF=6V and 1000 W output. When PWM=60%, the signal can be set to a reference signal of REF=4.2V and 700 W output. Photocouplers 105 in FIG. 1 are used as insulating interfaces to an inverter side and an external control board (a control board) side having different GND potentials.

Figure 2:
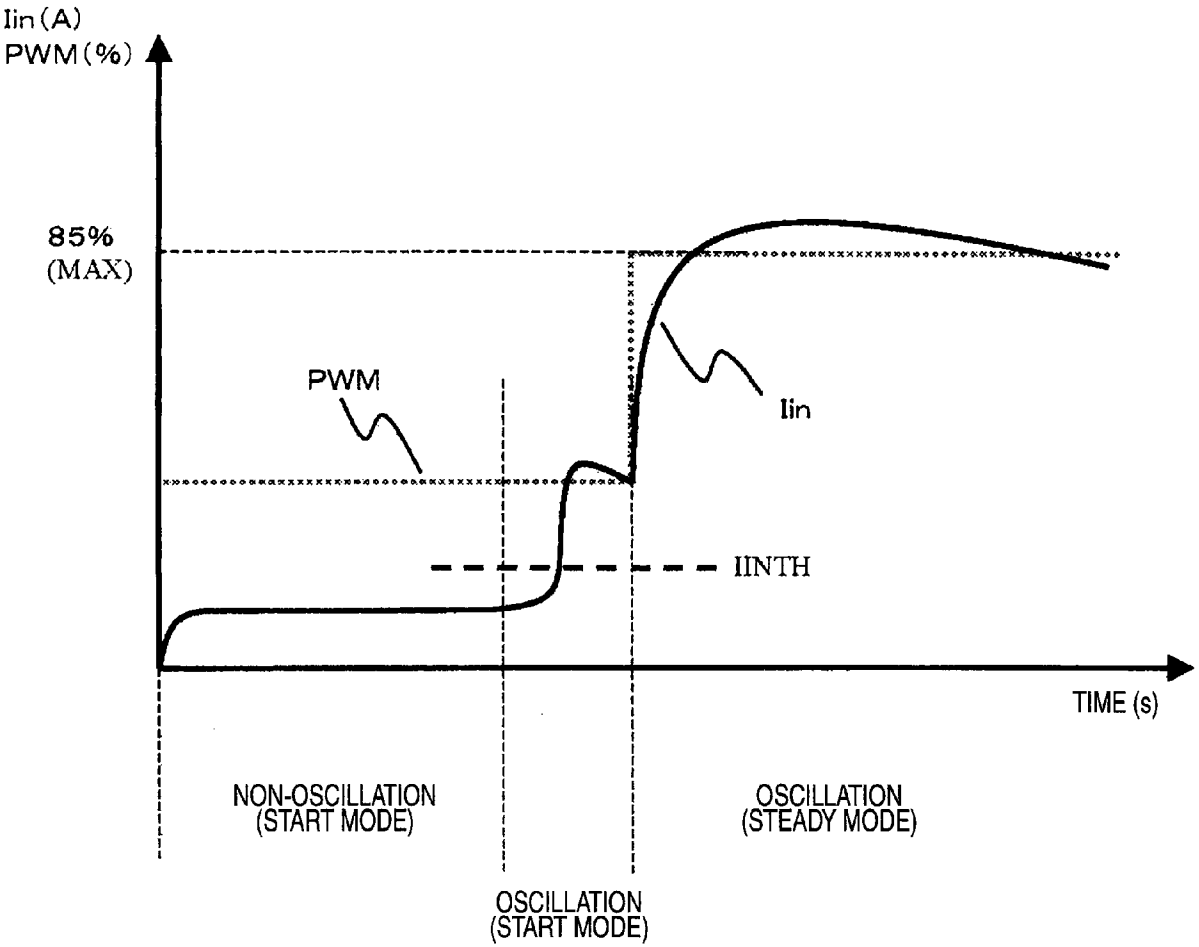
FIG. 2 is a figure of an input current characteristic in the transition from a non-oscillation to an oscillation of the magnetron in the first embodiment of the present invention.

FIG. 2 shows a figure of an input current characteristic in an input current Iin from a state that the magnetron does not oscillate to a state that the magnetron oscillates by the operation of the inverter power source for driving the magnetron according to the present invention. As shown in the drawing, the on duty of the PWM setting value is changed in the start mode and the steady mod so that the over-shoot of the input current is suppressed (claim 1). Namely, during an unstable state immediately after the oscillation of the magnetron, the on duty of the PWM setting value is set to a low level, so that the input current is controlled to be low. After it is recognized that the magnetron shifts to a stable oscillating state immediately after the oscillation, the PWM setting value is set to a normal and desired PWM setting value in the steady mode. Thus, even when the PWM setting value in the steady mode is a maximum output, the over-shoot is suppressed to realize a stable start.

Actually, the PWM signal from the external control board is converted into the reference signal REF proportional to the on duty in the inverter power source and transmitted to a driving part for controlling an operating frequency by comparing the reference signal with a signal obtained by converting the input current into a voltage to be equal in an input constant control part. At this time, a capacitor is used in a REF terminal to absorb an abrupt change of the on duty as shown in FIG. 2.

Further, in switching the PWM signal to the oscillation (the start mode) and to the oscillation (the steady mode), an IINTH threshold value shown in FIG. 2 is provided to decide a switching operation depending on whether or not the input current exceeds the threshold value. Further, immediately after the input current exceeds the IINTH threshold value, since the stability of the oscillation of the magnetron cannot be ensured, after a time lag about several times as long as a PWM period is provided in a communication of the inverter power source and the external control board, the PWM signal is switched to the PWM setting value of the steady mode.

As a point of the PWM setting value in the start mode to be noticed, an Iin value by the setting value is set to be larger than the IINTH threshold value. Otherwise, the PWM signal cannot be shifted to the PWM setting value in the steady mode.

Second Embodiment

Figure 3:
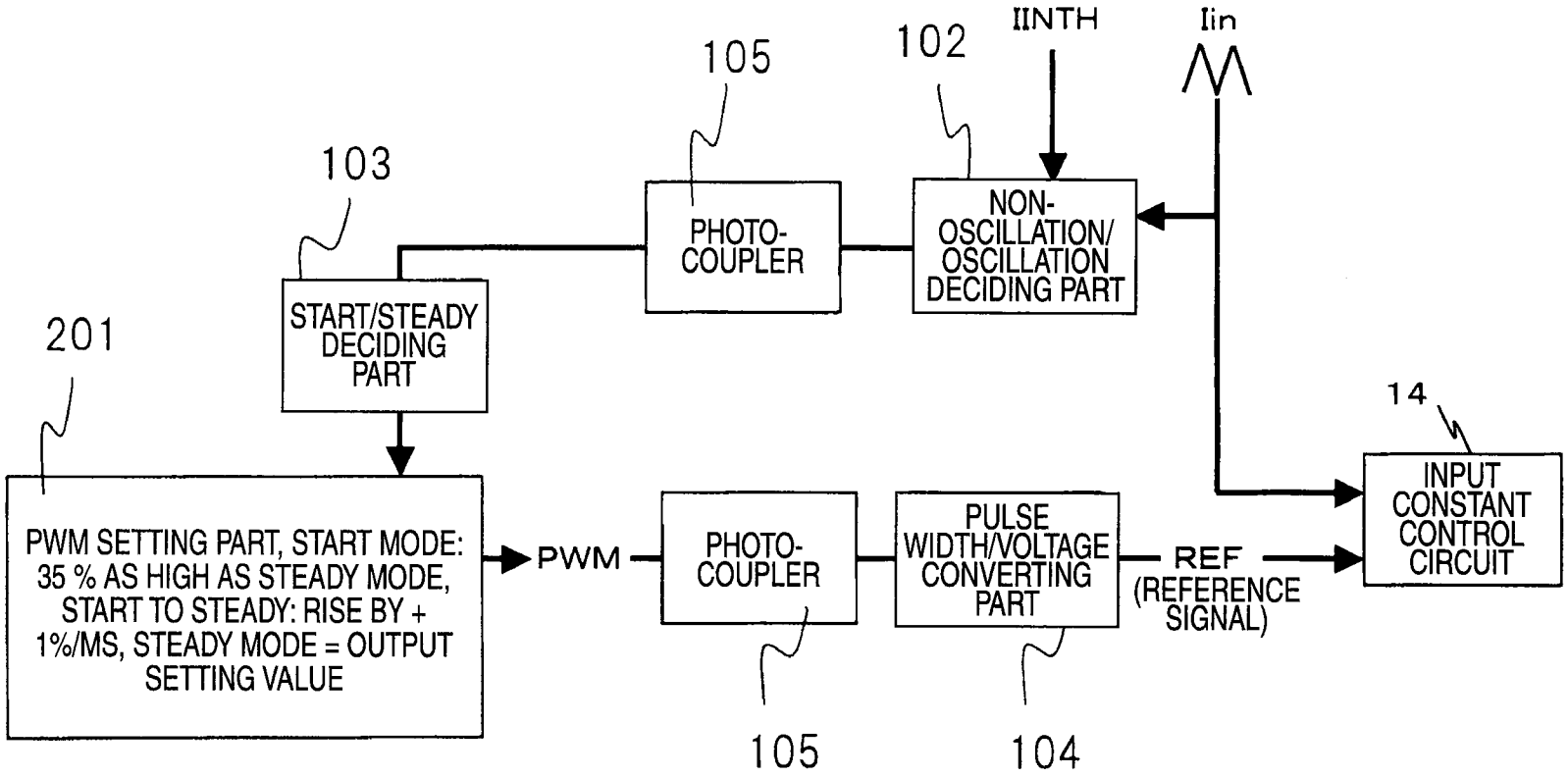
FIG. 3 is a schematic block diagram of an inverter power source for driving a magnetron of a second embodiment of the present invention.

FIG. 3 shows a schematic block diagram of an inverter power source for driving a magnetron of a second embodiment of the present invention. As described above, since the structure following a REF output signal is the same as the usual structure shown in FIG. 9, an explanation thereof is omitted herein. In the inverter power source for driving the magnetron of the second embodiment, as shown in FIG. 3, a start to steady control is added in a PWM setting part 201. Other processes are the same as those of the first embodiment and the same components as the above-described components are designated by the same reference numerals and an explanation thereof is omitted.

Figure 4:
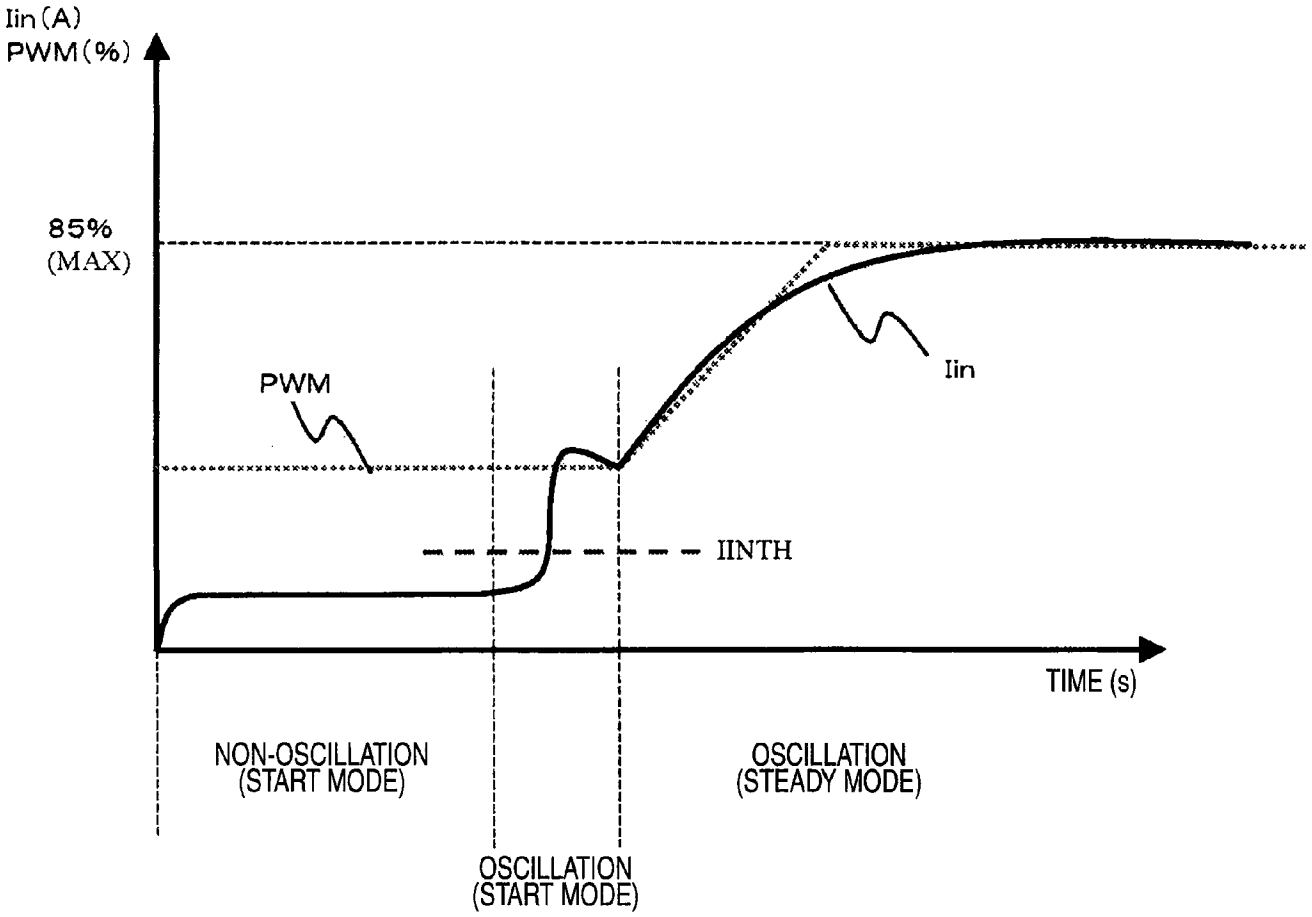
FIG. 4 is a figure of an input current characteristic in the transition from a non-oscillation to an oscillation of the magnetron in the second embodiment of the present invention.

FIG. 4 shows a figure of an input current characteristic of the second embodiment in which a setting value of a PWM signal is gradually changed from a start mode to a steady mode in addition to a system shown in FIG. 1. For instance, when the PWM setting value is 30% in the start mode, the PWM setting value is 85% at a MAX in the steady mode and reaches a final setting value of the steady mode after 55 ms in 1%/ms. In such a way, the over-shoot of the input current shown in the first embodiment can be more suppressed.

Third Embodiment

Figure 5:
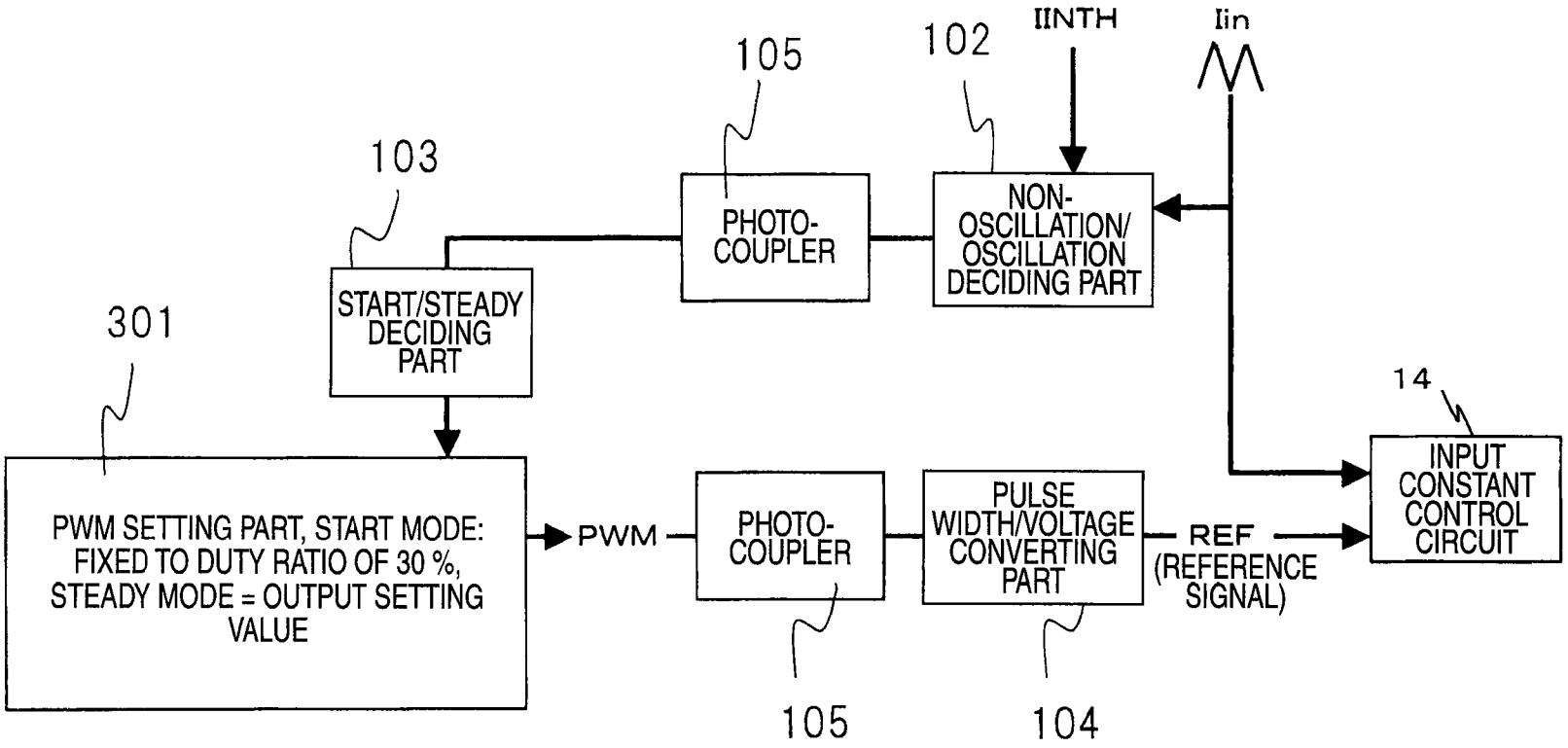
FIG. 5 is a schematic block diagram of an inverter power source for driving a magnetron of a third embodiment of the present invention.

FIG. 5 shows a schematic block diagram of an inverter power source for driving a magnetron of a third embodiment of the present invention. As described above, since the structure following a REF output signal is the same as the usual structure shown in FIG. 9, an explanation thereof is omitted herein. In the inverter power source for driving the magnetron of the third embodiment, as shown in FIG. 5, a setting value of a start mode is fixed to a duty ratio of 30% in a PWM setting part 301. Other processes are the same as those of the first embodiment and the same components as the above-described components are designated by the same reference numerals and an explanation thereof is omitted.

Figure 6:
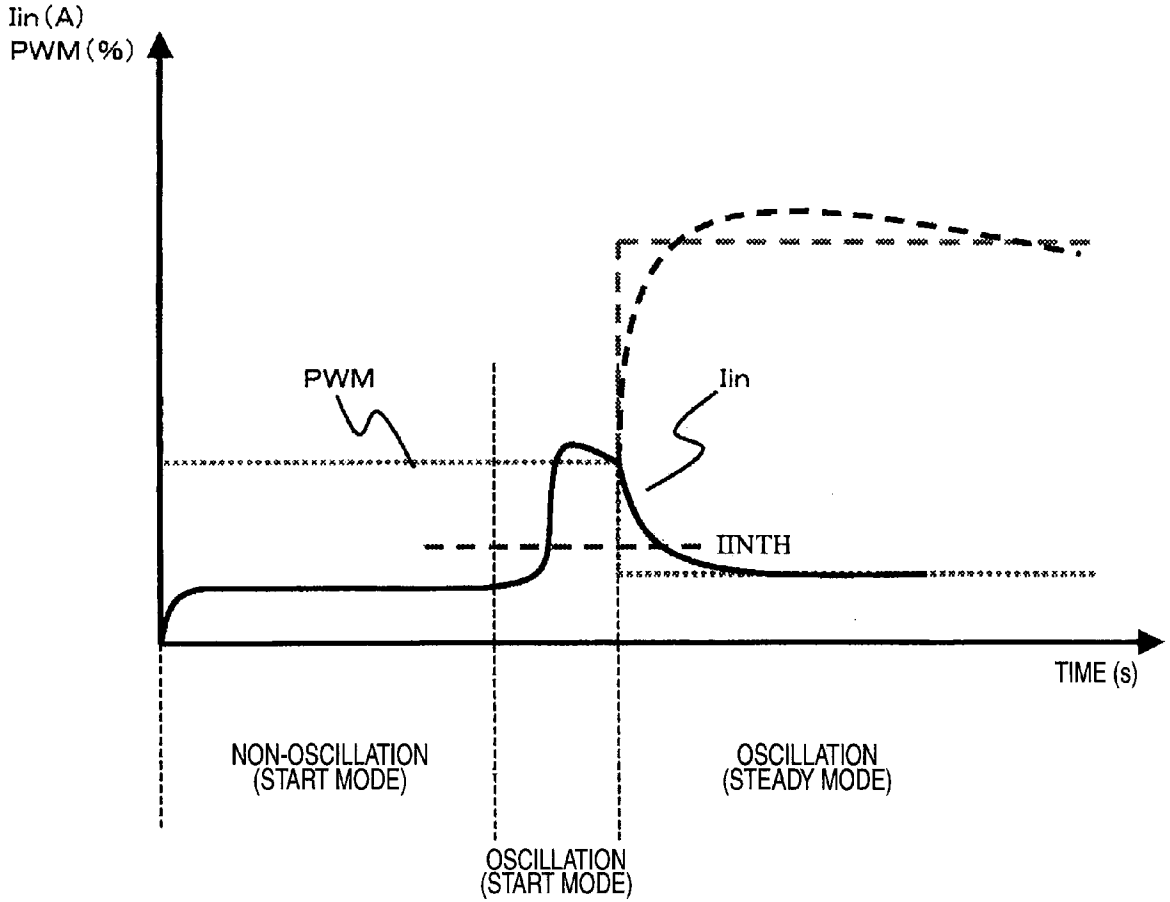
FIG. 6 is a figure of an input current characteristic in the transition from a non-oscillation to an oscillation of the magnetron in the third embodiment of the present invention.

FIG. 6 shows a figure of an input current characteristic of the third embodiment in which a PWM setting value of the start mode is fixed irrespective of a PWM setting value of a steady mode corresponding to each output level in the systems shown in the first and second embodiments. In this case, even when a minimum output value in the steady mode is lower than an IINTH threshold value, the PWM setting value in the start mode does not need to be especially calculated and set. The point of the PWM setting value in the start mode to be noticed that is described in the first embodiment may be observed and, the PWM setting value in the start mode may be set only once to such a value as to adequately suppress an over-shoot even in the case of a maximum output value in the steady mode.

Fourth Embodiment

Figure 7:
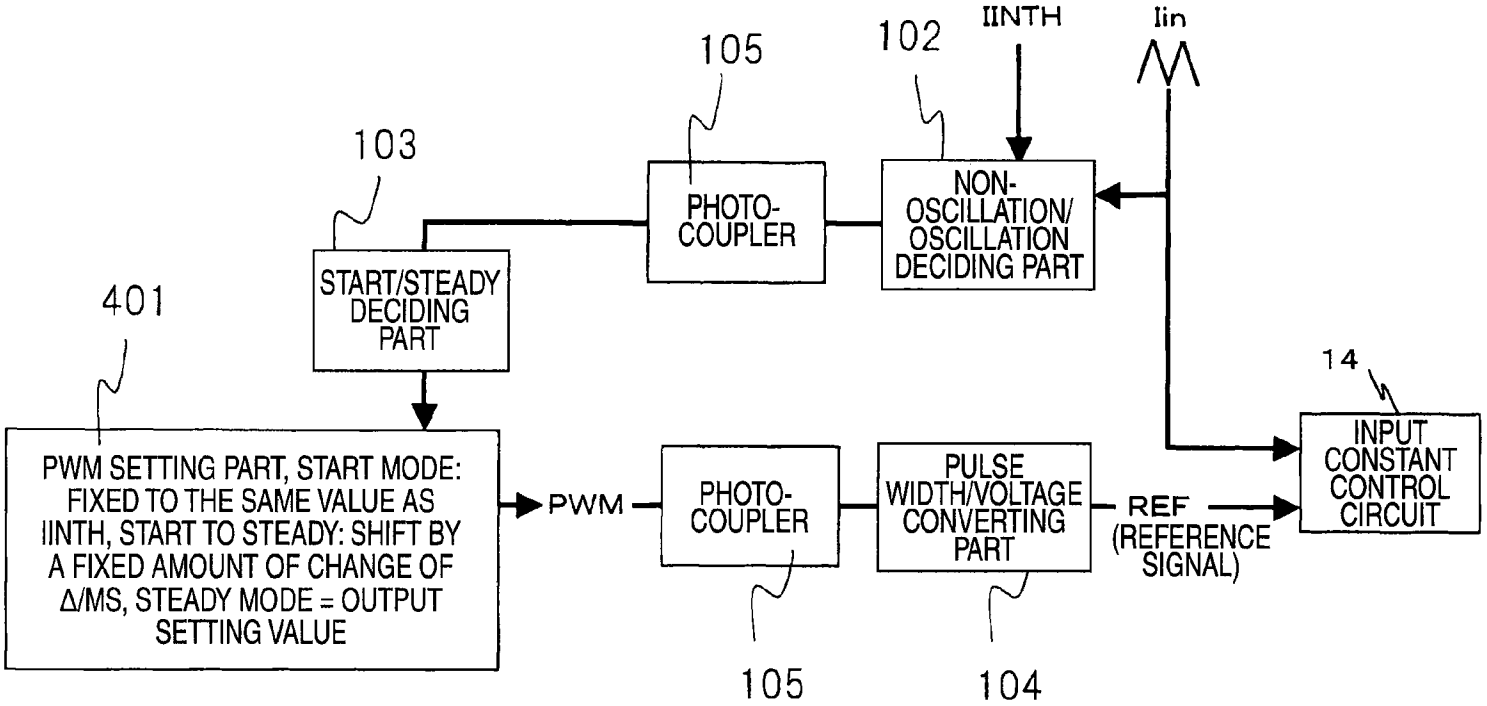
FIG. 7 is a schematic block diagram of an inverter power source for driving a magnetron of a fourth embodiment of the present invention.

FIG. 7 shows a schematic block diagram of an inverter power source for driving a magnetron of a fourth embodiment of the present invention. As described above, since the structure following a REF output signal is the same as the usual structure shown in FIG. 9, an explanation thereof is omitted herein. In the inverter power source for driving the magnetron of the fourth embodiment, as shown in FIG. 7, a setting value of a start mode is set to a value the same as an IINTH threshold value in a PWM setting part 401. Further, a shift from a start to steady is set to a fixed value of Δ (MAC-IINTH)/20 ms. Other processes are the same as those of the first embodiment and the same components as the above-described components are designated by the same reference numerals and an explanation thereof is omitted.

Figure 8:
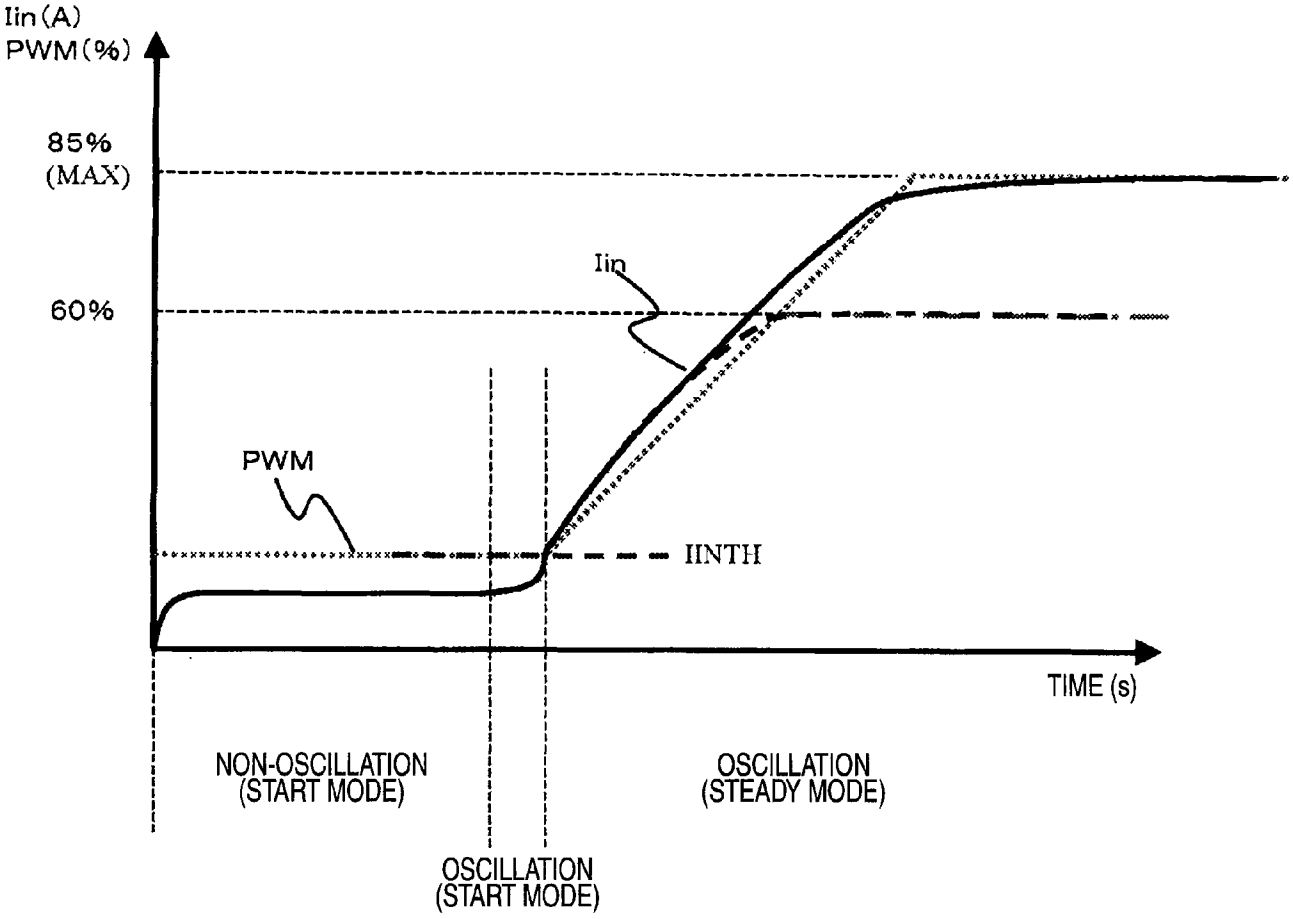
FIG. 8 is a figure of an input current characteristic in the transition from a non-oscillation to an oscillation of the magnetron in the fourth embodiment of the present invention.

FIG. 8 shows a figure of an input current characteristic of the fourth embodiment in which a PWM setting value of the start mode is set to a value the same as the IINTH threshold value in the system shown in the above-described third embodiment. Further, an inclination for changing the PWM setting value toward a PWM setting value in a steady mode is constant irrespective of each output level to eliminate a complicated control. By setting the inclination appropriate, the time lag about several times as long as a PWM period as described in the first embodiment does not need to be provided in a communication of the inverter power source and an external control board and the PWM setting value can be immediately shifted to the PWM setting value in the steady mode. In such a way, in the fourth embodiment, a start control by which an over-shoot is more smoothly suppressed can be realized.

The present invention is described in detail by referring to the specific embodiments, however, it is to be understood to a person with ordinary skill in the art that various changes or modifications may be made without departing from the spirit and scope of the present invention. This application is based on Japanese Patent Application No. 2005-245619 filed on Aug. 26, 2005, and contents thereof are incorporated herein as a reference.

INDUSTRIAL APPLICABILITY

As described above, according to the power supply for a high frequency heating, even if the PWM setting value during the steady mode is set to a maximum output value, the input current does not need to be controlled to a large current including the over-shoot immediately after the oscillation. After the magnetron shifts to a stable state, the PWM setting value shifts to a PWM setting value of an actual steady mode, so that the over-shoot of the input current can be suppressed as much as possible. Thus, the power supply for a high frequency heating can be applied to a various kinds of inverter circuits.

The invention claimed is:

1. A power supply for a high frequency heating that drives a magnetron by carrying out a high frequency switching operation by a semiconductor switching element using a commercial power source, wherein a control signal for an input current is used to suppress an over-shoot of the input current immediately after the magnetron begins oscillating, the power supply comprising a deciding part, wherein the control signal is set based on comparing, by the deciding part, the input current with a threshold value for the input current for deciding a non-oscillation (a start mode) and an oscillation (a steady mode) of the magnetron by the deciding part based on said comparing, wherein the deciding part receives a signal representative of the input current, and provides to a pulse width modulator (PWM) setting part of the power supply, an output signal indicating whether the magnetron is presently oscillating or not oscillating, the output signal being determined based on comparing the input current with the threshold value for the input current by the deciding part such that the output signal indicates that the magnetron is presently oscillating when the input current is greater than the threshold value, wherein the control signal for the input current sets different values in the non-oscillation (the start mode) and the oscillation (the steady mode) of the magnetron, and a setting value of the start mode of the control signal for the input current is less than a setting value of the steady mode.

2. The power supply according to claim 1, wherein the setting value of the start mode of the control signal for the input current is gradually changed to the setting value of the steady mode after the magnetron begins oscillating.

3. The power supply according to claim 1, wherein the setting value of the start mode of the control signal for the input current is constant irrespective of each output level of the steady mode.

4. The power supply according to claim 2, wherein the setting value of the start mode of the control signal for the input current is set so as to be the same as the threshold value for the input current for ascertaining the non-oscillation and the oscillation (both in the start mode) and then changed with the same inclination irrespective of each output level when the setting value of the start mode shifts to the setting value in the steady mode.

5. The power supply according to claim 2, wherein the setting value of the start mode of the control signal for the input current is constant irrespective of each output level of the steady mode.

* * * * *